United States Patent [101]

Lenmark

[11] 4,051,346

[45] Sept. 27, 1977

[54] TANK HEATING AND CONTROL UNIT

[76] Inventor: Voigt O. Lenmark, 7505 Highway 7, Minneapolis, Minn. 55426

[21] Appl. No.: 665,513

[22] Filed: Mar. 10, 1976

[51] Int. Cl.[2] ..... H05B 1/00; F24H 1/00

[52] U.S. Cl. ..... 219/328; 119/73; 219/336; 219/436; 219/441; 219/536

[58] Field of Search ..... 219/328, 536, 311–312, 219/336, 435, 436, 438, 441; 119/73

[56] References Cited

U.S. PATENT DOCUMENTS

| | | | |
|---|---|---|---|
| 2,875,315 | 2/1959 | Pierson, Jr. | 219/328 X |
| 3,193,662 | 7/1965 | Brandt | 219/536 X |

*Primary Examiner*—C. L. Albritton

*Attorney, Agent, or Firm*—Merchant, Gould, Smith, Edell, Welter & Schmidt

[57] ABSTRACT

An improved electric heating system for removable application to the bottoms of stock watering tanks. It consists of a substantially rigid heater element connected in series with a surface thermostat, for energization from a suitable electrical source. The element is forced into heat transfer relation with the outside of the bottom of said tank, and is rigidly connected to a thermostat bracket which simultaneously provides good heat transfer from the tank to the thermostat.

7 Claims, 5 Drawing Figures

FIG. 1
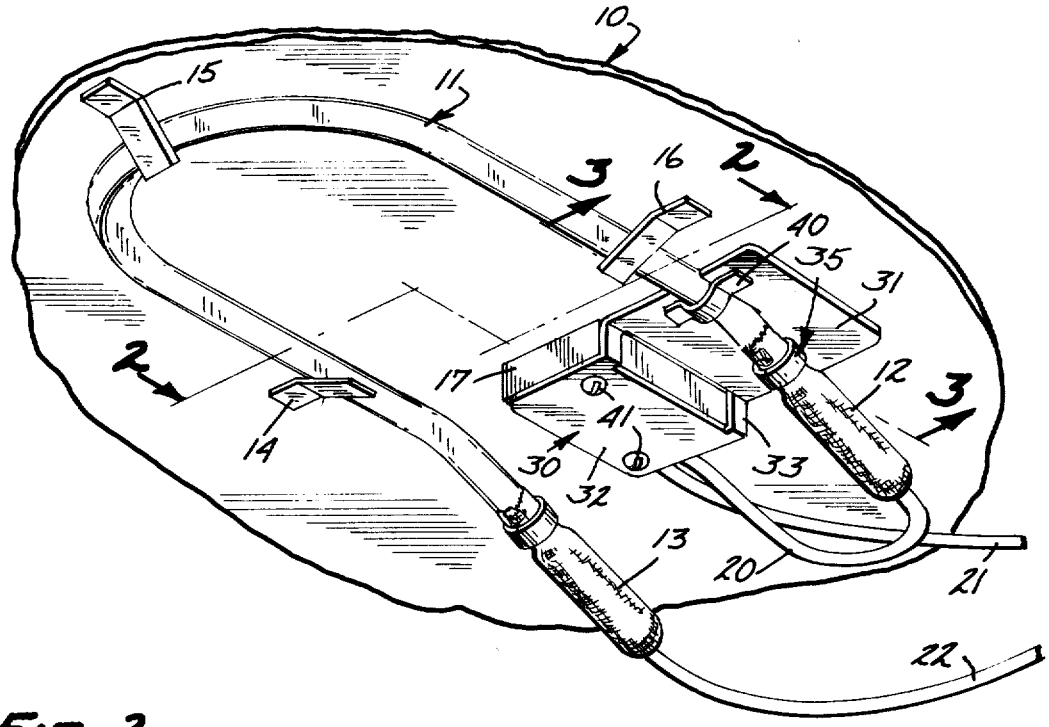
FIG. 2
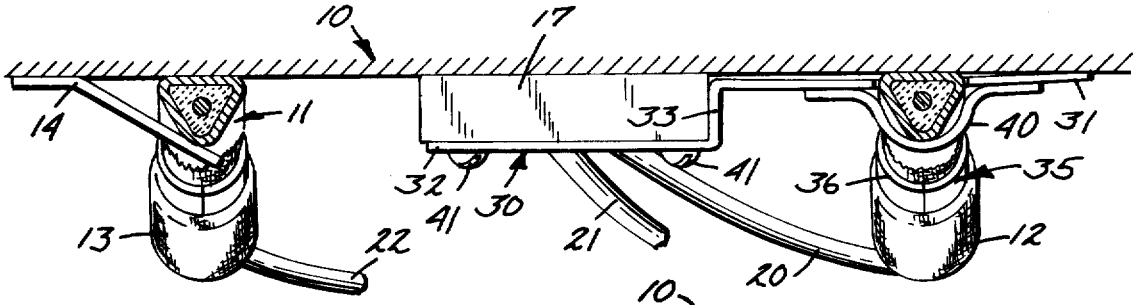
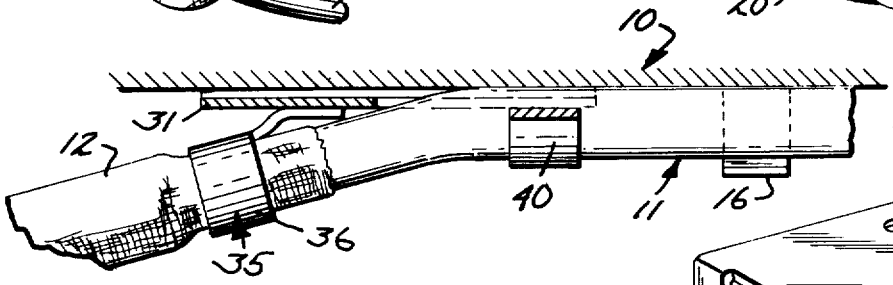
FIG. 3
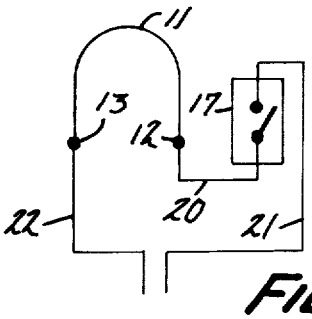
FIG. 5
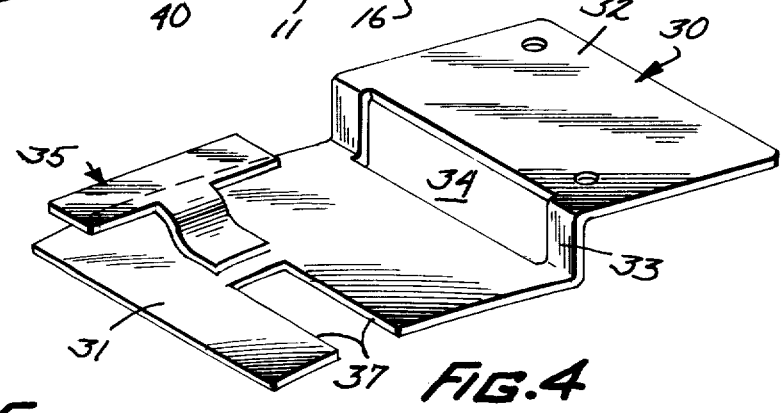
FIG. 4

TANK HEATING AND CONTROL UNIT

BACKGROUND OF THE DISCLOSURE

This invention relates to the field of electric heating, and particularly to improved means for heating the liquid in stock watering tanks. Such tanks are located in the open, and are subject by rough treatment by the stock being watered. While water must be kept available, during cold weather, by supplying heat to the system, the same adverse conditions apply to any electrical equipment used for that purpose. The equipment must therefore be as rugged as possible, and should also be readily removable to a less trying storage location when heat is no longer needed.

As in most electric heating applications, reasons of economy and efficiency dictate using a heater capable in continuous use of supplying the maximum heat requirements, and providing a thermostat to observe the water temperature and turn the heater off except when the temperature drops below a predetermined point.

Experience has taught that anything hanging or projecting into a stock watering tank has an intolerably short life. Heaters have been developed which are capable of functioning when secured to the outside of the tank bottom in heat exchange relation thereto, in which location they are largely protected from physical damage, and surface thermostats are also known which can give sufficiently exact response to the temperature of the water as conducted through the tank to its outer surface. Good thermal contact is of course necessary in both cases.

SUMMARY OF THE INVENTION

My invention relates to an improved electric heater and thermostat for application to the outside of a tank bottom to maintain the temperature of liquid in the tank above a minimum value. This I accomplish by providing securing means below the tank into which a substantially rigid electric heating element slides. I also provide a thermostat mounting plate which physically interconnects a surface thermostat with one end of the heating element at a location which will be near one of the means securing the element to the tank. Then when the heater is forced into place, in heat transfer relation to the tank bottom, the thermostat is similarly disposed, giving a unit which is easily applied and removed, which is protected by its location from physical damage, and in which the heat transfer relation between the tank and the electrical unit is automatically achieved.

It is accordingly a principle object of my invention to provide a new electric stock water heating system. Another object is to provide such a system in which a heater and thermostat are easily applied to a tank or removed therefrom, thermal contact for the heater and the thermostat being automatically provided. A more specific object is to provide such a system having a mounting plate for receiving a thermostat and securing it to a substantially rigid heating element in such a fashion that when the element is applied to a tank surface, good thermal conduction is achieved between the tank and the thermostat as well as between the tank and the heating element.

Various other objects, advantages, and features of novelty which characterize my invention are pointed out with particularilty in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWINGS

In the drawing

FIG. 1 is a perspective view looking upward at the bottom of a tank having my heating system installed;

FIG. 2 is a sectional view taken along the line 2—2 of FIG. 1;

FIG. 3 is a similar sectional view taken along the line 3—3 of FIG. 1;

FIG. 4 shows a bracket used in practicing my invention; and

FIG. 5 is a schematic wiring diagram of the system.

DESCRIPTION OF THE PREFERRED EMBODIMENT

In the drawing numeral 10 refers to the bottom of a tank for watering stock. A substantially rigid heating element 11 having a U-shaped configuration is shown to have terminals 12 and 13 at which electrical connection is made to the element, which is shown to be roughly triangular in cross section. A plurality of clips 14, 15, 16 are secured to the tank bottom 10, as by welding, and are positioned so that heating element 11 may be slidingly forced between them and thereby against tank bottom 10. A surface thermostat 17 is connected in series of element 11 by a conductor 20, and the series circuit is completed to a source of electrical energy by conductors 21 and 22. All connections must of course be made in an approved weather-tight manner.

I prefer to ensure that good thermal contact takes place between thermostat 17 and tank bottom 10 by use of a metal bracket 30 having a tank contacting portion 31 and a thermostat mounting portion 32 connected by a step portion 33 from which most of the metal has been removed, at 34, to minimize heat conduction directly to thermostat 17 from element 11. Affixed to portion 31 as by welding is clip 35 to be securely crimped around element 11 as at 36. Portion 31 is also cut away as at 37, to permit element 11 to depart smoothly from the tank surface, to be gripped in clamp 35. A strap 40 cooperates with clip 35 in securing bracket 30 to element 11. Thermostat 17 is secured to portion 32 of bracket 30 as by screws 41.

As best shown in FIG. 2, portion 31 of bracket 30 is slightly concave, and the thickness of thermostat 17 is slightly greater than the dimension of step portion 33 of bracket 31. Thus when element 11 is slid forcefully in place, clip 16 forces element 11 against the tank, and element 11 in turn acts against plate 31 of bracket 30, forcing the surface of thermostat 17, and the edge of portion 31 remote therefrom, into intimate heat transfer relation with the tank.

Numerous objects and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principal of the invention, to the full extent indicated by the broad general meaning of the terms in which the appended claims are expressed.

I claim as my invention:

1. In a heating unit for application to the outer surface of a stock watering tank, comprising a substantially rigid linear heating element configured to be held in contact with said surface when brought into engagement with securing means depending therefrom, and a surface thermostat connected to control said element and having a flat face for thermal engagement with said surface, the improvement which comprises:

a mounting plate for said thermostat, including a first portion to bear inwardly against said surface, a second portion secured to said thermostat to bear inwardly thereagainst, and means located between said portions for securing said plate directly to said element, so that when said element is held against said surface said thermostat and said plate are also held against said surface.

2. The structure of claim 1 in which said plate includes a cutout between said portions to minimize heat conduction from said element to said thermostat.

3. The structure of claim 1 in which said mounting plate is inwardly concave between said portions.

4. Ths structure of claim 1 in which said plate includes means located between said portions for securing said plate to said element at a location close to one of said securing means.

5. The structure of claim 1 in which said securing means are adapted to slidingly receive said element and thereupon impel said element and said plate into intimate thermal contact with said surface.

6. The structure of claim 1 in which said first portion is offset from said second portion by an amount slightly less than the thickness of said thermostat.

7. The structure of claim 1 in which the space between said thermostat and said element at said plate is sufficient to substantially prevent conductive heat transfer therebetween.

* * * * *